US008894728B2

(12) United States Patent
Pavone et al.

(10) Patent No.: US 8,894,728 B2
(45) Date of Patent: Nov. 25, 2014

(54) DEVICE FOR GASIFICATION OF CARBONACEOUS FUELS

(75) Inventors: Domenico Pavone, Bochum (DE); Ralf Abraham, Bergkamen (DE); Muhammad Iqbal Mian, Dortmund (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 776 days.

(21) Appl. No.: 12/737,823

(22) PCT Filed: Aug. 13, 2009

(86) PCT No.: PCT/EP2009/005871

§ 371 (c)(1), (2), (4) Date: Mar. 21, 2011

(87) PCT Pub. No.: WO2010/020372

PCT Pub. Date: Feb. 25, 2010

(65) Prior Publication Data

US 2011/0179713 A1 Jul. 28, 2011

(30) Foreign Application Priority Data

Aug. 20, 2008 (DE) ..... 10 2008 038 485

(51) Int. Cl.
*C10J 1/207* (2012.01)

(52) U.S. Cl.
USPC ..... 48/76; 48/61; 48/67; 48/69; 48/65; 48/71; 48/72; 48/73; 48/127.9; 48/127.1; 48/200; 48/201; 48/202; 48/203

(58) Field of Classification Search
None
See application file for complete search history.

(56) References Cited

U.S. PATENT DOCUMENTS

| | | | | |
|---|---|---|---|---|
| 3,218,998 | A | 11/1965 | Fairman et al. | |
| 3,915,137 | A * | 10/1975 | Evans | 123/549 |
| 4,095,777 | A | 6/1978 | Honaker | |
| 5,630,853 | A | 5/1997 | Eales | |
| 7,216,442 | B2 * | 5/2007 | Cheng | 34/198 |
| 7,537,740 | B2 * | 5/2009 | Gschwind | 422/198 |
| 2003/0010766 | A1 * | 1/2003 | Haluschka et al. | 219/270 |

FOREIGN PATENT DOCUMENTS

| | | |
|---|---|---|
| DE | 31 23 356 | 10/1982 |
| DE | 3123356 | * 10/1982 |
| DE | 195 40 641 | 5/1997 |
| DE | 196 54 402 | 12/1997 |
| EP | 0 413 799 | 2/1991 |
| GB | 886 745 | 1/1962 |

OTHER PUBLICATIONS

International Search Report.

* cited by examiner

*Primary Examiner* — Kaity Handal
(74) *Attorney, Agent, or Firm* — Collard & Roe, P.C.

(57) ABSTRACT

In the case of a device for gasification of carbonaceous fuels, having a discharge for slags into a slag bath, a solution is supposed to be created with which the gasifier discharge opening is reliably kept at a temperature that guarantees that the slag will flow out. This is achieved in that the gasifier discharge opening (6) is equipped with a ceramic drip edge (7) that can be electrically heated.

4 Claims, 2 Drawing Sheets

DEVICE FOR GASIFICATION OF CARBONACEOUS FUELS

CROSS REFERENCE TO RELATED APPLICATIONS

This application is the National Stage of PCT/EP2009/005871 filed on Aug. 13, 2009, which claims priority under 35 U.S.C. §119 of German Application No. 10 2008 038 485.2 filed on Aug. 20, 2008, the disclosure of which is incorporated by reference. The international application under PCT article 21(2) was not published in English.

BACKGROUND OF THE INVENTION

1. Field of the Invention

The invention is directed at a device for gasification of carbonaceous fuels, having a discharge for slags into a slag bath.

2. Description of the Related Art

In the gasification of carbonaceous fuels, for example bituminous coal or anthracite, refinery residues, biomasses, and the like, the processes in gasifiers, among other things, are structured in such a manner that the mineral components of the materials used are melted to form liquid slags, which then flow downward in the walls of the gasifiers, which are generally cylindrical, and then leave the gasifier through a slag hole, drip into a water bath that is situated underneath that, and are granulated there.

In order to guarantee continuous operation of the gasifiers, care must be taken to ensure that the gasifier discharge opening does not become clogged here, so that it is known to provide support burners in this region, which provide for temperatures there that are high enough so that discharge of the slag is ensured.

Such solutions are shown, for example, by U.S. Pat. Nos. 3,218,998, 4,095,777, or 5,630,853, to mention only a few examples. These solutions with support burners are very complicated, since they require very many additional elements, whereby an additional disadvantage consists in that the support burners must be directed at the surface of the flowing slag in the drip-off region, in order to maintain the flow temperature.

SUMMARY OF THE INVENTION

Container outlets that can be heated inductively are shown by DE 195 40 641 C2 or DE 196 54 402 C2. This heating system cannot be used in the present area of use; it would lead to significant problems.

Since the flow point of a slag is dependent, among other things, on the alkali concentration in the slag, the burner flame directed at the surface brings about the result that the alkali substances evaporate out of the slag in preferred manner, and this leads to the result that the flow temperature of the slag is significantly increased, so that then, once again, the burner power is increased, and this in turn leads to accelerated outgassing of the alkalis.

Because of the need for a constant increase in the burner power, mantle-side wall overheating can occur, in this connection, and in the worst case, this leads to shut-off of the system.

This is where the invention takes its start, whose task consists in reliably keeping the gasifier discharge opening at a temperature that guarantees that the slag will flow out.

This task is accomplished, according to the invention, with a device of the type indicated initially, in that the gasifier discharge opening is equipped with a drip edge that can be electrically heated, whereby the heating system is formed by an electrical, ceramic resistance heating system.

Using such a drip edge that can be electrically heated, it is possible to achieve the result, with simple means, that the required temperature is maintained, and at the same time, only a slight structural effort must be made.

Fundamentally, drains that can be electrically heated are known from DE 195 40 641 C2 or DE 196 54 402 C2. However, these solutions relate to other technical areas of application and cannot easily be transferred to the present technical field.

It is practical, according to the invention, if the drip edge is formed by simple oxide or non-oxide ceramics or mixtures of corresponding ceramics.

In this connection, the invention provides that the drip edge that can be electrically heated is heated directly or indirectly. the ceramics that are used here can be, according to the invention, $Al_2O_3$, $Cr_2O_3$, CaO, $Fe_2O_3$, $HfO_2$, MgO, $SiO_2$, $SnO_2$, $TiO_2$, $ZrO_2$, AlN, $MoSi_2$, SiC, BN, cermets, whereby the ceramics mentioned here can be used individually or also in combination.

The invention also provides that the power feed into the drip edge that can be electrically heated is formed from a power feed rod consisting of an electrically conductive ceramic, such as $MoSi_2$, for example, whereby the power feed rod is enclosed by a ceramic that is not electrically conductive.

The advantages that result from the invention furthermore consist in that alkali evaporation cannot come about because of the possibility of precise temperature regulation, and thus the slag viscosity does not increase. An advantage of an electrically conductive ceramic also consists in that the conductivity increases with an increasing temperature, whereby the ceramic is very resistant to slag and high temperatures, and the regulation can be carried out as a ceramic resistance heating system.

If the drip edge consists of multiple ceramic elements, for example, which can be produced according to all common methods, then the connection can be made by means of an electrically conductive adhesive, for example, or corresponding elements for an electrical connection can already be provided during sintering, for example.

BRIEF DESCRIPTION OF THE DRAWINGS

Further characteristics, details, and advantages of the invention are evident from the following description and using the drawing. This shows, in FIG. 1 a fundamental representation of a gasifier having a drip edge according to the invention, FIG. 2 a partial top view of the drip edge with power feed, FIG. 3 a top view of a drip edge with indirect ceramic heating, as well as in FIG. 4 in the same representation as in FIG. 3, the drip edge with direct heating.

DETAILED DESCRIPTION OF THE PREFERRED EMBODIMENTS

Figure 1:
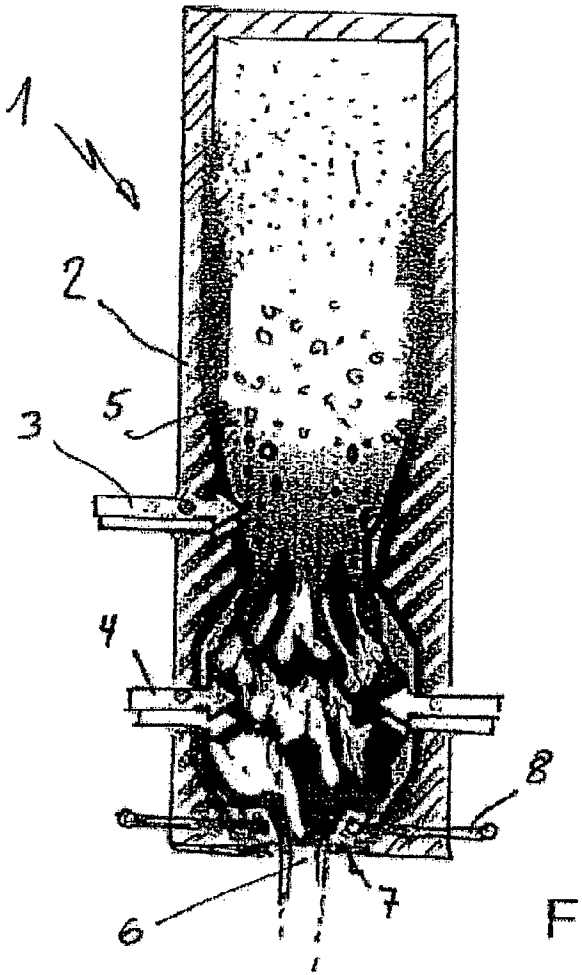

The gasifier for gasification of carbonaceous fuels, shown very schematically and designated in general with 1 in FIG. 1, has a feed for the fuel to be gasified, designated with 3, in a refractory housing 2, along with feed lines for other media 4, for example during startup of the gasifier. The slag that forms in the combustion space, designated with 5, flows out of the gasifier at the lower end, in the direction of gravity, into a water bath that is not shown in any detail, whereby the gasifier discharge opening is designated with 6, the drip edge, in general, carries the reference symbol 7, the power feed lines are indicated with 8.

Figure 2:
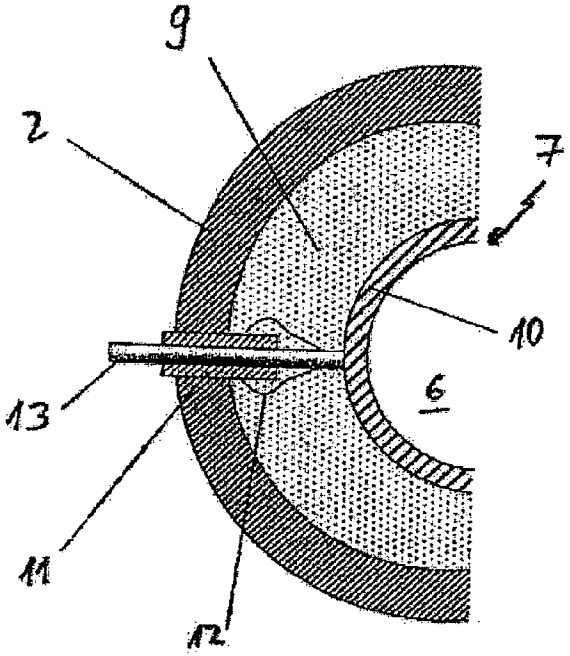

In FIG. 2, the structure of such a drip edge is indicated more specifically in a detail. There, the wall of the refractory housing 2 is lined with a rammed-layer lining material 9, for example, which defines the gasifier discharge opening 6 and is provided, on its inside wall, with a ceramic heating element 10, whereby this heating element forms the drip edge 7.

The power feed line 8 is formed by a power feed rod 13 consisting of electrically conductive ceramic, which is enclosed by a sleeve 11 consisting of a ceramic that is not electrically conductive, which sleeve passes through the rammed-layer lining material, also in not electrically conductive manner. In the example shown, a shrink-fit hose 12 is furthermore provided, which serves for sealing the power feed rod with regard to the container or the sleeve, in order to prevent a short-circuit between the wall of the refractory housing 2 and the power feed rod 13.

Figure 3:
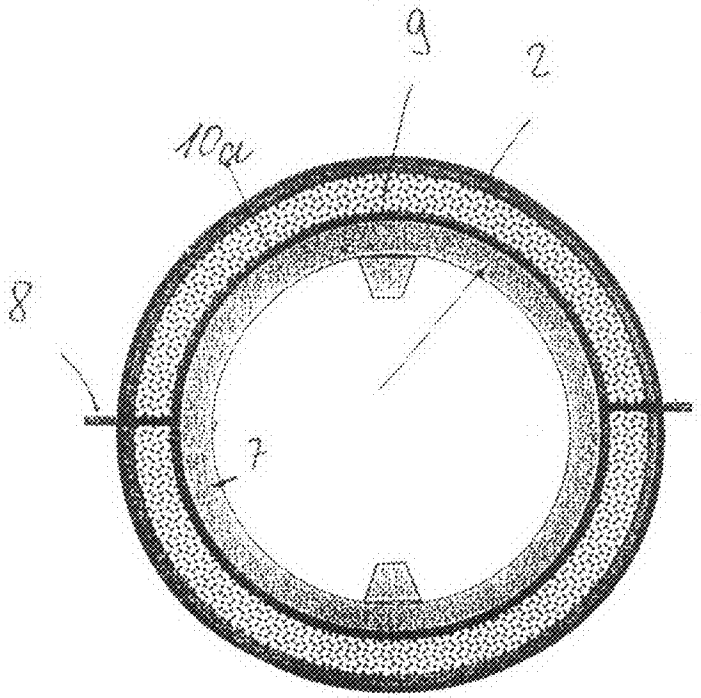

In FIG. 3, indirect heating of the ceramic that forms the drip edge 7 is shown, whereby the electrical resistance heating system 10*a* can be formed from SiSiC, for example, while the slag-resistant ceramic consists of $Al_2O_3.Cr_2O_3$, for example. It is evident that the ceramic resistance heating system is positioned directly behind the slag-resistant ceramic, so that the ceramic is then directly transferred to the slag-resistant ceramic in the drip region of the gasifier, whereby the ceramic resistance heating system is separate from the aggressive slag.

Figure 4:
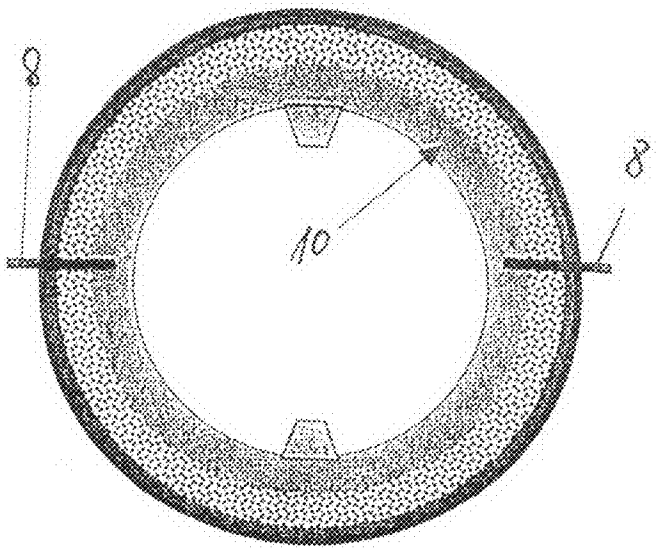

In contrast to this, FIG. 4 shows a directly heated ceramic ring 10, which is configured as a ceramic resistance heating system, and in this connection, the material is selected in such a manner that it is not only slag-resistant but also conductive.

It is practical if the power feed rods 13 are produced from a material such as $MoSi_2$, for example, in other words the electrical resistance is less than the resistance of the ceramic heating conductor, whereby the electrical resistance is temperature-independent. The material mentioned here can be used at temperatures of up to 1800° C.

Of course, the exemplary embodiment of the invention that has been described can still be modified in many respects without departing from the basic idea. For example, the invention is particularly not restricted to a specific geometric shape of the resistance heating system, and also, the termination ring of the gasifier opening that forms the drip edge does not have to be configured in one piece, and more of the like.

The invention claimed is:

1. Device for gasification of carbonaceous fuels, having a discharge for slags into a slag bath, wherein the gasifier discharge opening is equipped with a ceramic drip edge that is electrically heated via an electric heating system, wherein the heating system is formed by an electrical, ceramic resistance heating system, wherein the electric heating system comprises a power feed rod comprising an electrically conductive ceramic, and wherein the power feed rod is enclosed by a ceramic that is not electrically conductive.

2. Device according to claim 1, wherein the ceramic drip edge is directly heated.

3. Device according to claim 1, wherein the ceramic drip edge is indirectly heated.

4. Device according to claim 1, wherein the ceramic that can be electrically heated is formed from $Al_2O_3$, $Cr_2O_3$, CaO, $Fe_2O_3$, $HfO_2$, MgO, $SiO_2$, $SnO_2$, $TiO_2$, $ZrO_2$, AlN, $MoSi_2$, SiC, BN, cermets, individually or in combination.

* * * * *